United States Patent [19]

Avery et al.

[11] Patent Number: 4,458,444

[45] Date of Patent: Jul. 10, 1984

[54] TRACK LAYING TOY VEHICLE

[75] Inventors: Roger Avery, Cumberland, R.I.; Irving C. Dudley, Millford; John Feroce, Marion, both of Mass.

[73] Assignee: Hasbro Industries, Inc., Pawtucket, R.I.

[21] Appl. No.: 425,105

[22] Filed: Sep. 27, 1982

[51] Int. Cl.[3] ..... A63H 17/36

[52] U.S. Cl. ..... 446/433

[58] Field of Search ..... 46/262, 251, 219, 206, 46/201, 253, 252, 213

[56] References Cited

U.S. PATENT DOCUMENTS

| | | | |
|---|---|---|---|
| 3,014,311 | 12/1961 | Ernst | 46/253 |
| 3,386,406 | 6/1968 | Tsunoda | 46/262 X |
| 4,152,866 | 5/1979 | Suda | 46/251 |

FOREIGN PATENT DOCUMENTS

| | | | |
|---|---|---|---|
| 1297012 | 6/1969 | Fed. Rep. of Germany | 46/219 |
| 1213563 | 11/1970 | United Kingdom | 46/201 |
| 1569496 | 6/1980 | United Kingdom | 46/219 |

*Primary Examiner*—Mickey Yu

*Attorney, Agent, or Firm*—Salter & Michaelson

[57] ABSTRACT

A motorized track laying vehicle is operable for forward, reverse and turning movement by manipulation of a turret on the vehicle. The turret is movable between forward, intermediate and rearward positions on the vehicle to correspondingly control the vehicle for forward, stopped and reverse modes. The vehicle is steered by rotating the turret in a desired direction to thereby disengage an appropriate track laying assembly.

5 Claims, 9 Drawing Figures

FIG. 1
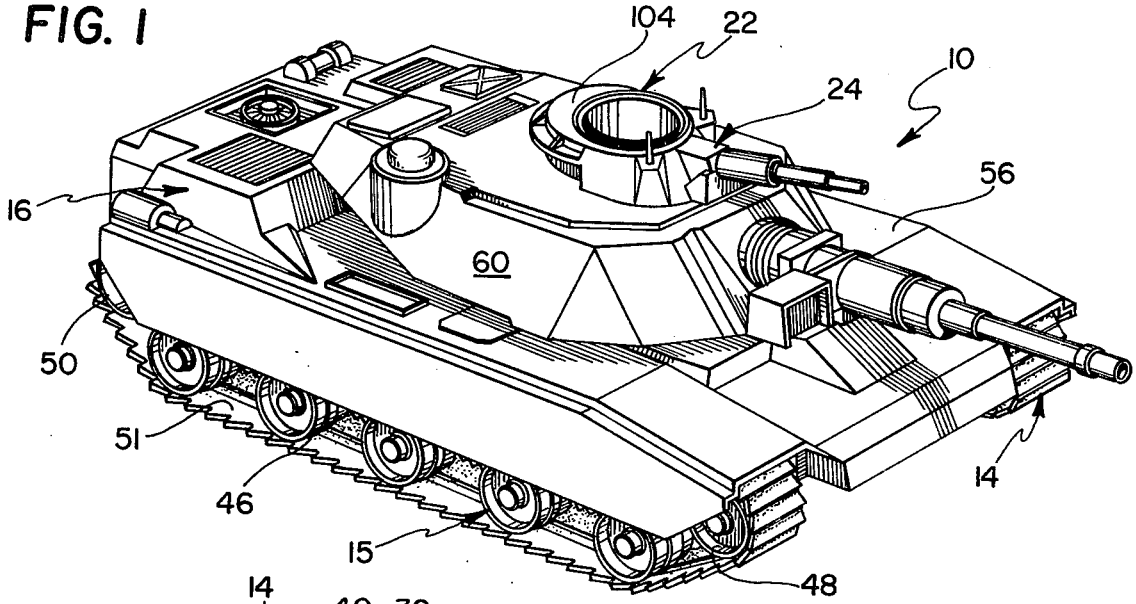
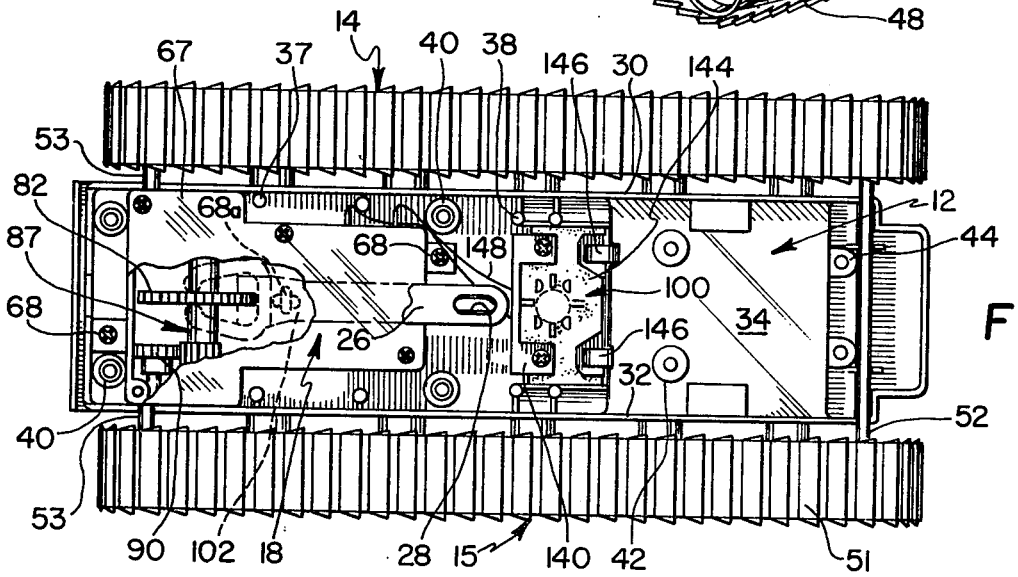
FIG. 2
FIG. 3
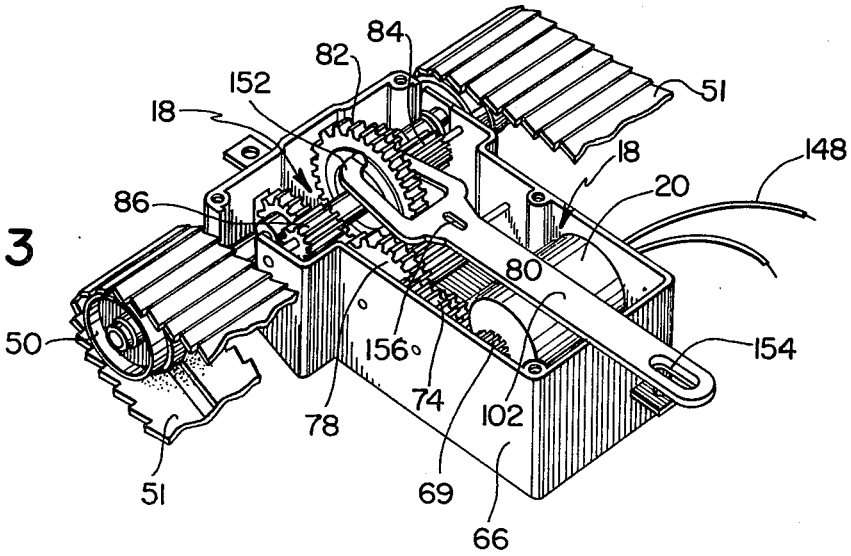

FIG. 4
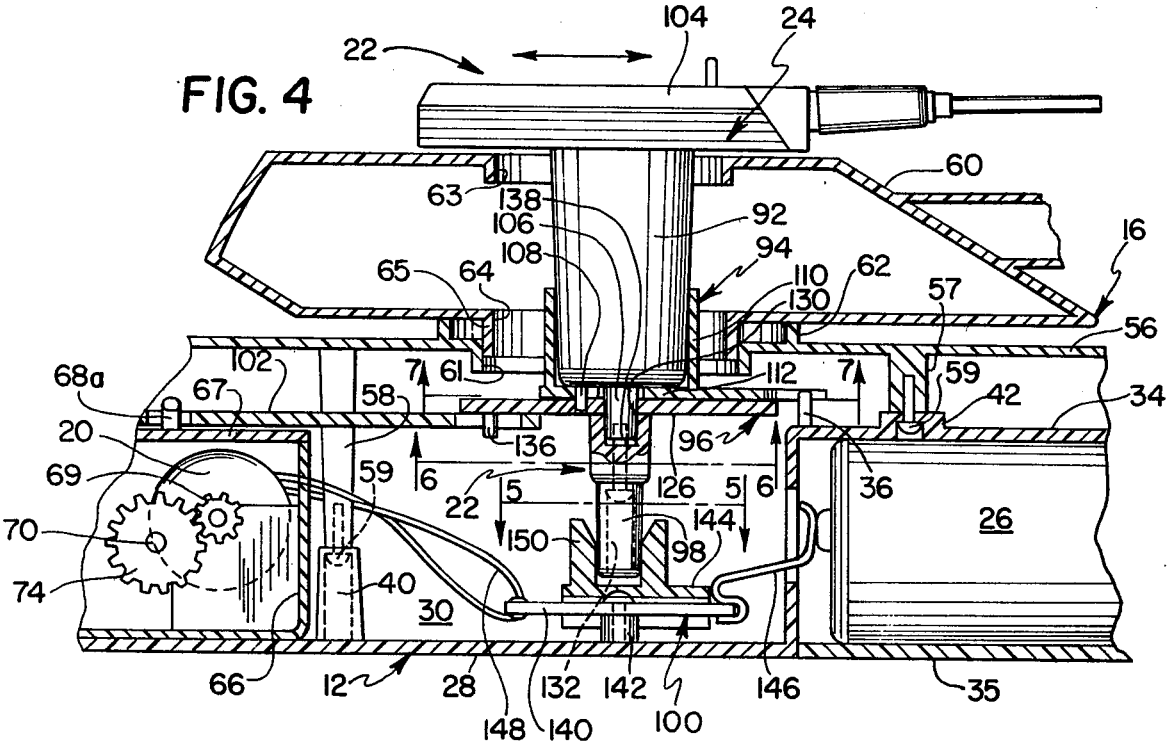
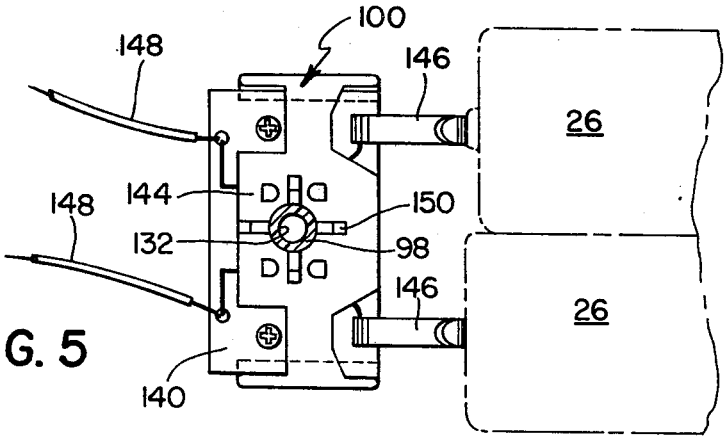
FIG. 5
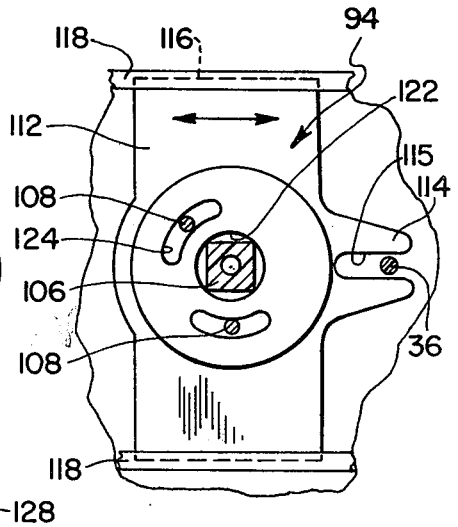
FIG. 7
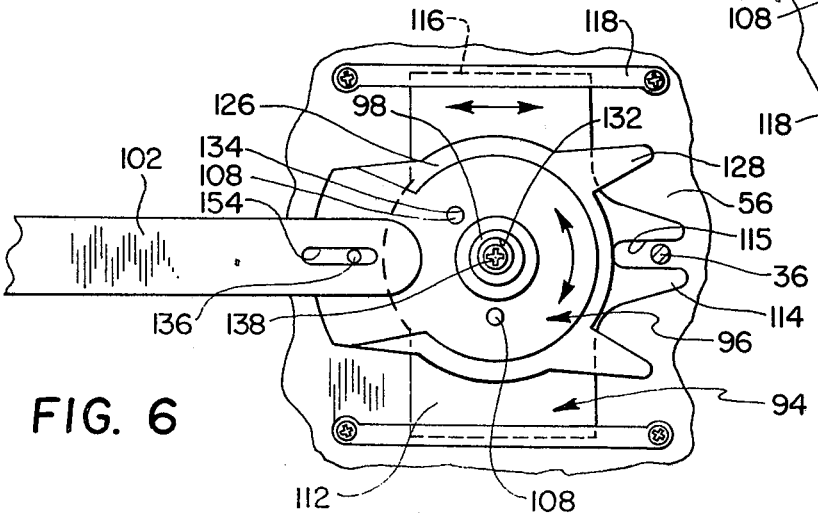
FIG. 6

TRACK LAYING TOY VEHICLE

BACKGROUND AND SUMMARY OF THE INVENTION

The instant invention relates to toy vehicles and more particularly to a motorized track laying toy vehicle.

A variety of types of track laying toy vehicles have heretofore been available and have proven to be commercially successful as a result of their substantial toy value. Track laying toy vehicles, such as tanks and tractors, have proven to be effective at capturing the attention and imagination of children to provide them with substantial amusement.

The instant invention provides a novel track laying vehicle having substantially enhanced play value as a result of its unique operation. Specifically, the operation of the track laying vehicle of the instant invention is controlled by manipulation of a movable control turret on the vehicle. The turret is longitudinally movable relative to the vehicle between forward, intermediate and rearward positions to correspondingly effect forward, stopped and reverse operation of the vehicle. In addition, the turret is rotatable to the left and to the right to correspondingly steer the vehicle to the left and to the right. To effect this operation, the vehicle includes drive and control assemblies which are responsive to rotation of the turret to selectively engage and disengage the appropriate elements driving the vehicle track assemblies whereby the vehicle can be turned to the right by disengaging the components which drive the right track and turned to the left by disengaging the components which drive the left track.

The closest prior art to the subject invention of which the applicant is aware is disclosed in the U.S. Pat. Nos. to NIELSEN et al, 3,065,569; GAGNON, 3,744,181; GULLEY, JR., 3,849,931; KURITA, 4,198,0449; and KURITA, 4,231,182. In this connection, the U.S. Pat. No. to NIELSEN et al, 3,065,569 discloses a self-propelled toy tank vehicle having a movable turret. The U.S. Pat. No. to GAGNON, 3,744,181 discloses a track laying vehicle which is controllable through remote control means to individually operate the treads thereof in forward or reverse directions. The U.S. Pat. No. to KURITA, 4,231,182 also discloses a track laying vehicle having a movable turret. However, none of these references relate to or teach a track laying vehicle which is controllable for forward, reverse and turning movement by manipulation of a turret on the vehicle. They also do not disclose or teach the specific control and drive mechanisms which are embodied in the vehicle of the subject invention, and hence they are not felt to be anticipatory. The remainder of the patents cited are felt to be of nothing more than general interest. Accordingly, it is a primary object of the instant invention to provide a track laying vehicle which is controllable by manipulation of a turret on the vehicle.

Another object of the instant invention is to provide a track laying vehicle having a turret which can be turned toward a particular direction to steer the vehicle toward said direction and which is movable between forward, intermediate and rearward positions on the vehicle to effect forward, stopped and reverse vehicle operation.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view of the toy vehicle of the instant invention;

FIG. 2 is a top plan view of the chassis of the vehicle with the vehicle body removed and with portions of the gear assembly housing broken away;

FIG. 3 is a fragmentary perspective view of the vehicle illustrating the gear drive assembly thereof;

FIG. 4 is a fragmentary side sectional view of the vehicle;

FIG. 5 is a sectional view taken along line 5—5 in FIG. 4;

FIG. 6 is a sectional view taken along line 6—6 in FIG. 4;

FIG. 7 is a sectional view taken along line 7—7 in FIG. 4;

DESCRIPTION OF THE INVENTION

Figure 8:
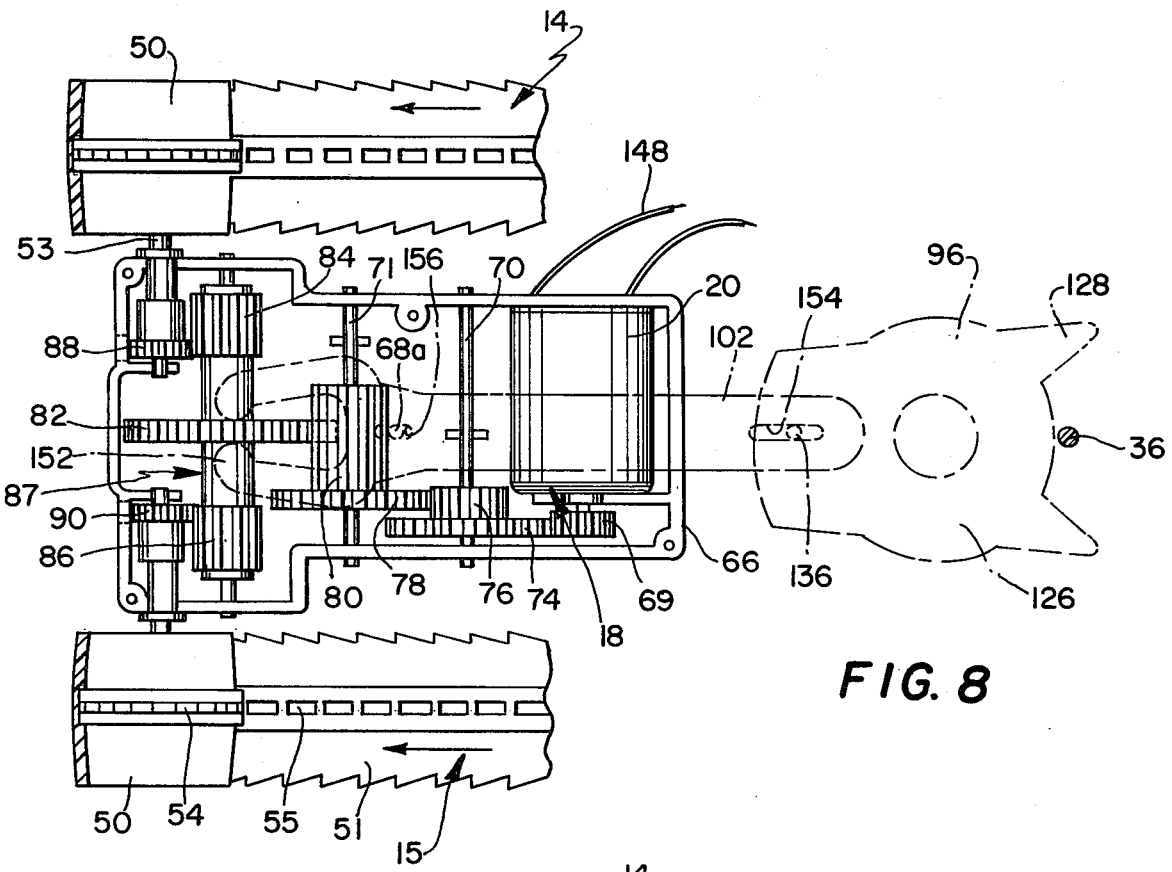
FIG. 8 is a fragmentary sectional view illustrating the drive assembly of the vehicle.

Referring now to the drawings, particularly FIG. 1, the track laying toy vehicle of the instant invention is illustrated and genera11y indicated at 10. The vehicle 10 includes a chassis, generally indicated at 12, which is mounted on track laying assemblies generally indicated at 14 and 15, for movably supporting the vehicle 10 on a supporting surface. A body generally indicated at 16, a drive assembly generally indicated at 18 which includes a drive motor 20, and a control assembly generally indicated at 22 which includes a control turret 24 are also included in the vehicle 10. The vehicle 10 is powered by batteries 26 and is operable by manipulation of the control turret 24 to effect selective operation of the track laying assemblies 14 and 15 to control the vehicle 10 for forward, reverse and turning movement.

Referring now particularly to FIGS. 2 and 4, the chassis 12 is preferably made of a suitable rigid plastic material and comprises a bottom wall 28 having integrally molded upstanding side walls 30 and 32 and an integrally molded battery well 34 which opens downwardly and has a detachable bottom cover 35. A pin 36 extends upwardly from the central rear portion of the top of the well 34 for reasons which will hereinafter be set forth. The chassis 12 includes structural elements 37 and 38 to increase the rigidity thereof as well as apertured posts 40 and apertured bosses 42 and 44 for securing various other elements of the toy 10 to the chassis 12.

The track laying assemblies 14 and 15 each comprise a plurality of roller wheels 46, a front idler wheel 48, a rear drive wheel 50, and a continuous flexible belt or track 51. The roller wheels 46 are journaled to the side walls 30 and 32, and the idler wheels 48 are mounted on an axle 52 which is mounted on the front of the chassis 12. The drive wheels 50 are mounted on independent drive shafts 53 which are journaled in the drive assembly 18 and extend outwardly through the side walls 30 and 32 at the rear of the chassis 12, as illustrated in FIG. 2. The drive wheels 50 include radially extending teeth 54 which are receivable in closely spaced slots 55 on the inner sides of the belts 51 to drivingly connect the wheels 50 to the belts 51 to effect longitudinal movement thereof for the advancement of the vehicle 10 on a supporting surface. Further, in this connection, the belts 51, which are preferably made of a suitable flexible rubberized material, are received in expanded dispositions on their respective wheels 46, 48 and 50 so that when the vehicle 10 is placed on a supporting surface and the wheels 50 are rotated, the belts 51 are continuously laid and advanced on the surface to effect movement of the vehicle 10.

Referring particularly to FIGS. 1 and 4, the body 16 includes a hollow shell or base portion 56 having downwardly projecting mounting posts 57 and 58 whereby the base portion 56 is mounted on the chassis 12 with screws 59. The body 16 also includes a cannon turret 60 which is rotatably mounted on the base portion 56. An enlarged opening 61 is provided on the upper side of the base portion 56 and a concentric flange 62 extends upwardly therearound. An opening 63 is provided in the upper portion of the cannon turret 60, and an opening 64 which is in alignment therewith and which is defined by a downwardly extending flange 65 is provided in the lower portion of the cannon turret 60. The turret 60 is mounted on the base portion 56 so that the lower surface of the turret 60 bears on the flange 62 and so that the flange 65 is received in the opening 61 whereby the turret 60 is rotatably supported on the base portion 56 with the flange 65 maintaining it in desired aligned relation.

Figure 9:
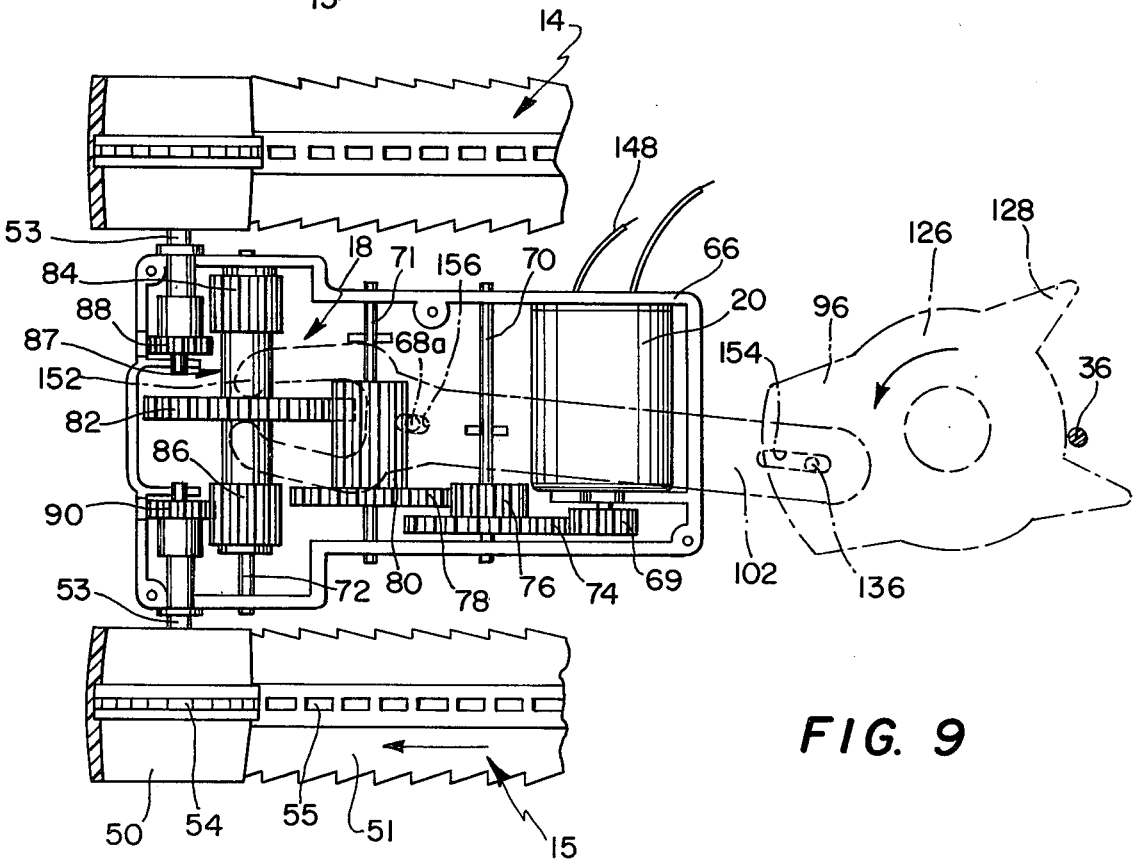
FIG. 9 is a similar view illustrating the drive assembly as operated to effect turning of the vehicle.

The drive assembly 18 is most clearly illustrated in FIGS. 2, 3, 8 and 9. Included in the drive assembly 18 is a housing 66 which has a cover 67 and which is mounted on the rear portion of the chassis 12 with mounting screws 68 as illustrated in FIG. 2. An upwardly extending pivot pin 68*a* having an enlarged head is integrally molded in the cover 67 for reasons which will be hereinafter set forth. The drive assembly 18 also includes the motor 20 which is a DC type electrical motor and has a motor gear 69 mounted thereon. To the rear of the motor 20, first, second and third transmission gear shafts 70, 71 and 72, respectively, are mounted in the housing 66. Gears 74 and 76 are mounted on the first shaft 70, and gears 78 and 80 are mounted on the second shaft 71. The gears 74, 76, 78 and 80 cooperate to communicate rotation from the motor gear 69 to a main transmission gear 82 which is slidably mounted on the third transmission gear shaft 72. Also slidably mounted on the third transmission gear shaft 72 and interconnected with the main transmission gear 82 are first and second transmission gears 84 and 86 which are disposed on opposite sides of the gear 82. The gears 82, 84 and 86 comprise a transmission gear assembly 87 which is transversely slidable as a unit in the vehicle 10 on the shaft 72. It should be brought out, however, that as the assembly 87 slides on the shaft 72, the gear 82 remains in communication with the gear 80 due to the wide configuration of the gear 80. Also included in the drive assembly 18 are first and second drive shaft gears 88 and 90 which are mounted on the drive shafts 53 on opposite sides of the vehicle 10. As illustrated in FIGS. 8 and 9, when the transmission gear assembly 87 is moved on the shaft 72, it is selectively positionable thereon to alternatively provide communication between the adjacent transmission and drive shaft gears 84 and 88, respectively, the adjacent transmission and drive shaft gears 86 and 90, or communication between both the adjacent gears 84 and 88 and the adjacent gears 86 and 90. As a result, by selectively positioning the transmission gear assembly 87, communication between the motor 20 and either or both of the drive shaft gears 88 and 90 is provided to selectively drive either or both of the track assemblies 14 and 15.

The control assembly 22 which is operable to both effect the energization of the motor 20 for forward and reverse operation of the vehicle 10 and to effect shifting of the transmission assembly 87 as hereinabove described is illustrated most clearly in FIGS. 4 through 7. Referring first to FIG. 4, it is seen that the control assembly 22 comprises the control turret 24 which includes a downwardly projecting neck portion 92, a guide sleeve 94, a steering plate 96 which includes a downwardly extending leg 98, a switch element 100 and a linkage yoke 102.

The control turret 24, which is preferably molded of a suitable rigid plastic, includes an external turret body 104, the neck portion 92 which is of slightly downwardly and inwardly tapered cylindrical configuration and which extends downwardly from the body 104 and a steering post 106 which is of rectangular section and which extends downwardly from the lower central portion of the neck portion 92. Also included in the control turret 24 are steering pins 108 which extend downwardly from the bottom of the neck portion 92 in outwardly spaced relation to the axis of the post 106. The control turret 24 is disposed on the vehicle 10 so that the neck portion 92 extends downwardly through the openings 63 and 64 in the cannon turret 60 and through the opening 61 in the base portion 56.

The guide sleeve 94 is illustrated in FIGS. 4, 6 and 7 and comprises a tubular sleeve portion 110 which extends upwardly from a transverse base portion 112 having forwardly extending fingers 114 which define a slot 115 therebetween. Slide portions 116 which are integrally attached to the base portion 112 are received in spaced tracks 118 which are mounted on the underside of the base portion 56 of the body 16 in substantially longitudinal dispositions in the vehicle 10. The guide sleeve 94 is disposed in the vehicle 10 so that it is longitudinally slidable therein with the slide portions 116 traveling in the tracks 118 and with the guide pin 36 in the slot 115. Provided in the alignment sleeve 94 at the bottom end of the sleeve portion 110 are a central opening 122 and a pair of arcuate slots 124 which are radially spaced from the opening 122. The neck portion 92 of the control turret 24 is received in the sleeve portion 110 so that the steering post 106 extends through the opening 122 and so that the steering pins 108 can travel in the slots 124 whereby the turret 24 is rotatable relative to the guide sleeve 94 but nevertheless longitudinally movable in the vehicle 10 therewith.

The steering plate 96 is illustrated in FIGS. 4, 6, 8 and 9 and comprises a plate portion 126 which includes a pair of radially spaced generally forwardly extending fingers 128. The leg 98 extends downwardly from the plate portion 126 and a socket 130 of rectangular section extends downwardly from the plate portion 126 into the leg 98. A central bore 132 extends upwardly a distance from the bottom of the leg 98 and a pair of apertures 134 are provided in the plate 126 in radially outwardly spaced relation to the leg 98. A yoke pin 136 extends downwardly from the central rear portion of the plate portion 126. As illustrated, the steering plate 96 is disposed beneath the base portion 112 of the guide sleeve 94. The pins 108 on the control turret 124 are received in the apertures 134 and the rectangular post 106 is received in the rectangular socket 130 whereby the steering plate 136 is nonrotatable relative to the control turret 24. A screw 138 extends upwardly from the bore 132 and is received in threaded engagement in the post 106 whereby the steering plate 96 is secured in the vehicle 10 so that it is rotatable with the control turret 24 relative to the guide sleeve 94. Damage to the control and/or drive assemblies 22 and 18, respectively, resulting from turning the turret 24 too far is prevented by the engagement of the fingers 128 with the pin 36. The control turret 24, the guide sleeve 94 and the steering plate 96 are nevertheless longitudinally movable in the vehicle 10 with the slide portions 116 travelling in the tracks 118. Further, the guide sleeve 94 and the steering plate 96 cooperate to retain both the control turret 24 and the cannon turret 60 on the vehicle 10. Specifically, the control turret 24 is secured to the steering plate 96 with the screw 138 and hence is retained in the vehicle 10 by the slide portions 116 which engage the tracks 118 on the undersurface of the top of the base portion 56. The neck portion 92 of the control turret 24 extends through the openings 63 and 64 in the cannon turret 60, and therefore the control turret 24 also retains the cannon turret 60 in rotatable relation on the base portion 56. It should also be brought out that when the control turret 24, the cannon turret 60, the guide sleeve 94 and the steering plate 96 are assembled in the vehicle 10 in this manner, the turret 24 and the steering plate 96 are in generally aligned relation, and the neck portion 92 is longitudinally movable in the vehicle 10 in the openings 63, 64 and 61.

The switch element 100 is illustrated in FIGS. 2, 4 and 5 and comprises a three position switch which is operable to control the motor 20 for forward, stopped or reverse modes to effect corresponding operation of the vehicle 10. The switch 100 includes a circuit plate 140 which is secured to a boss 142 which extends upwardly from the bottom wall 28 of the chassis 12. A switch plate 144 is slidably mounted on the circuit plate 140 and is adapted to effect or interrupt electrical continuity, as desired, by sliding it forwardly or rearwardly in the vehicle 10 relative to the circuit plate 140. The circuit plate 140 is electrically connected to the batteries 26 with contact elements 146 and to the motor 20 with wires 148. The switch element 100 is constructed so that when the switch plate 144 is moved to a forward position relative to the circuit plate 140, the motor 20 is energized to effect forward movement of the vehicle 10 and so that when the plate 144 is moved to a rearward position relative to the plate 140 the motor is energized to effect rearward movement of the vehicle 10. A stopped position of the switch element 100 wherein the motor 20 is deenergized is defined by a central position of the switch plate 144 which is between the forward and rearward positions thereof. Extending upwardly from the switch plate 144 are lugs 150 which are positioned so that they cooperate to receive the leg 98 of the steering plate 96. This provides mechanical interconnection between the control turret 24 and switch element 100 whereby the vehicle 10 can be operated for forward, stopped and reverse modes by correspondingly moving the control turret 24 between forward, intermediate and rearward positions thereof.

The linkage yoke 102 provides interconnection between the steering plate 96 and the drive assembly 18, specifically to effect shifting of the transmission gear assembly 87. The yoke 102 comprises an elongated element having a pair of opposed jaws 152 at the rearward end thereof. An elongated slot 154 is provided adjacent the forward extremity of the yoke 102 and a reduced slot 156 is provided at an intermediate point therein. The yoke 102 is disposed in the vehicle 10 so that the ends of the jaws 152 engage opposite sides of the main transmission gear 82, so that the pivot pin **68*a* extends upwardly through the slot 156 and so that the pin 136 extends downwardly through the slot 154. Accordingly, as illustrated in FIGS. 8 and 9 when the steering plate 96 is rotated, the yoke 102 pivots about the pivot pin 68*a* to move the transmission gear assembly 87 along the third transmission gear shaft 72. It is seen that when the plate 96 is rotated toward a particular side of the vehicle 10, the transmission gear assembly 87 is moved toward the same side of the vehicle causing the track assembly on that side of the vehicle to be disengaged. For example, as illustrated in FIG. 9, when the plate 96 is rotated generally toward the track assembly 14 side of the vehicle 10, i.e. counterclockwise, the track assembly 14 is disengaged while the track assembly 15 is fully engaged by means of gears 86 and 90. This causes the vehicle 10 to turn in the general direction of the track assembly 15. Hence, it is seen that the vehicle 10 can be steered to one side or the other by directing the control turret 24 in the desired direction of vehicular travel. The vehicle 10 proceeds in a generally straight direction, however, when the control turret 24 is directed forwardly so that both the gears 84 and 86 of the transmission gear assembly 87 engage their respective drive shaft gears 88 and 90. The elongated configuration of the slot 154 permits the pin 136 to travel therein when the turret 24 is moved forwardly or rearwardly so that the operation of the switch element 100 does not interfere with the shifting of the gear assembly 87**.

It is seen therefore that the instant invention provides a unique track laying vehicle which is controllable by manipulation of the control turret 24 to effect forward, reverse and turning movement. More specifically, by moving the control turret 24 between forward, intermediate and rearward positions thereof, the vehicle is correspondingly operated in forward, stopped and reverse modes. In addition, when the vehicle 10 is in its forward operational mode, and the turret 24 is turned toward a particular direction, the vehicle 10 turns generally toward the same direction. When the vehicle 10 is in a reverse operational mode, and the control turret 24 is turned toward a particular direction, the vehicle 10 is turned in a corresponding reverse direction. The unique control and drive assemblies of the vehicle 10 provide an effective new dimension in track laying vehicles and make the vehicle of the subject invention particularly effective at capturing the imagination and attention of children. For these reasons, the track laying vehicle of the subject invention provides a significant improvement in the toy art which has substantial commercial merit.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A motorized toy vehicle comprising:

a. a chassis;

b. spaced first and second movable support means attached to said chassis and supporting same for movement thereof on a supporting surface;

c. a reversible drive motor mounted on said chassis;

d. means for energizing said motor;

e. drive means drivingly connecting said motor to said first and second support means and individually disengageable therefrom to alternatively operate said vehicle in a first mode wherein said motor is drivingly connected to only said first support means, a second mode wherein said motor is drivingly connected to only said second support means, or a third mode wherein said motor is drivingly connected to both said first and second support means;

f. switch means on said vehicle operable for controlling the energization of said motor to effect forward and reverse movement of said vehicle;

g. a control member mounted on the exterior of said vehicle for manual manipulation thereof by an operator, said control member being movable forwardly and rearwardly with respect to said chassis to actuate said switch means for corresponding forward and reverse movement of said vehicle and also being axially rotatable toward various desired directions of vehicular travel; and h. linkage means on said vehicle interconnecting said control member to said drive means for shifting same between said first, second, and third modes in response to axial rotation of said control member so that when said drive motor is energized for forward movement of said vehicle, the direction of travel of said vehicle is controllable by rotating said control member toward the desired direction of vehicular travel.

2. In the vehicle of claim 1, said drive means comprising:

(a) first and second substantially transverse drive shafts mounted on said vehicle and communicating with said first and second support means, respectively, to independently effect movement thereof;

(b) first and second drive shaft gears mounted on said first and second drive shafts, respectively;

(c) a transmission gear shaft substantially transversely mounted in said vehicle;

(d) a transmission gear assembly including interconnected first and second transmission gears and a main transmission gear, said transmission gear assembly being mounted on said transmission gear shaft and being substantially transversely movable thereon between a first position wherein only said first drive and transmission gears are in communication, a second position thereon wherein only said second drive and transmission gears are in communication and a third position thereon wherein both said first drive and transmission gears and said second drive and transmission gears are in communication; and (e) gear means communicating rotation of said motor to said main transmission gear, but nevertheless permitting said transverse movement thereof in said vehicle, said linkage means communicating with said main transmission gear assembly to thereby shift between said first, second and third positions thereof.

3. In the vehicle of claim 2, said linkage means further characterized as including a yoke member which is engageable with opposite sides of said main transmission gear to effect said transverse movement thereof.

4. In the toy of claim 3, said control member further characterized as a turret on said vehicle which is rotatable to effect said shifting.

5. The vehicle of claim 1, further characterized as a track laying vehicle, said control member further characterized as a turret on said vehicle which is rotatable to effect said shifting.

* * * * *